US008371677B2

(12) United States Patent
Fukasawa

(10) Patent No.: US 8,371,677 B2
(45) Date of Patent: Feb. 12, 2013

(54) INKJET PRINTING APPARATUS

(75) Inventor: Takuya Fukasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/215,493

(22) Filed: Aug. 23, 2011

(65) Prior Publication Data

US 2012/0050366 A1 Mar. 1, 2012

(30) Foreign Application Priority Data

Aug. 25, 2010 (JP) ..... 2010-188432

(51) Int. Cl.
*B41J 2/165* (2006.01)

(52) U.S. Cl. ..... 347/35

(58) Field of Classification Search ..... 347/35
See application file for complete search history.

(56) References Cited

FOREIGN PATENT DOCUMENTS

JP 2007-144698 A 6/2007

*Primary Examiner* — Julian Huffman
(74) *Attorney, Agent, or Firm* — Fitzpatrick, Cella, Harper & Scinto

(57) ABSTRACT

An inkjet printing apparatus is provided by which, even under an environment in which water in ink easily evaporates (e.g., a high temperature and a low humidity), the humidification of the ambience near the nozzle opening can be provided by the control depending on the temperature and humidity or the printing mode. Thus, such an inkjet printing apparatus is provided that can provide a high-quality printing while reducing the amount of waste ink or cost. To realize this, ink is ejected to the platen absorber and is humidified. Then, water evaporated from the platen absorber is used to humidify the nozzle section of the print head.

8 Claims, 15 Drawing Sheets

| NUMBER OF EJECTION - TIME | | TEMPERATURE T [DEGREES C ] | |
|---|---|---|---|
| | | T≦25℃ | 25℃＜T |
| HUMIDITY U[%] | 70＜U≦100 | 4.0sec | 4.0sec |
| | 30＜U≦70 | 3.0sec | 2.0sec |
| | 0≦U≦30 | 2.0sec | 1.0sec |

FIG.8

| | BEAUTIFUL | | | FAST |
|---|---|---|---|---|
| | 1 | 2 | 3 | 4 |
| PLAIN PAPER | 16 PASSES, BIDIRECTIONAL, 25 inch/s | 8 PASSES, BIDIRECTIONAL, 25 inch/s | 8 PASSES, BIDIRECTIONAL, 25 inch/s | 4 PASSES, BIDIRECTIONAL, 25 inch/s |
| SPECIAL PAPER | 16 PASSES, BIDIRECTIONAL, 15 inch/s | 16 PASSES, BIDIRECTIONAL, 20 inch/s | 12 PASSES, BIDIRECTIONAL, 20 inch/s | 8 PASSES, BIDIRECTIONAL, 20 inch/s |

FIG.9

INKJET PRINTING APPARATUS

BACKGROUND OF THE INVENTION

1. Field of the Invention

The present invention relates to an inkjet printing apparatus to eject and fly ink droplets through ink ejection openings of a print head to attach the ink droplets to a to-be-printed matter for printing. The present invention also relates to the reduction of factors causing the deterioration of an image such as an ejection defect.

2. Description of the Related Art

In recent years, printing apparatuses used for a printer, a copier, and a facsimile for example have higher performance requirements, including not only a high-speed printing and a full color printing but also a high-definition image equal to that by the silver halide photography. With regard to such requirements, an inkjet printing apparatus to eject ink for printing can eject minute ink droplets at a high frequency. Thus, the inkjet printing apparatus is superior in the high-speed printing and a high-quality printing to printing apparatuses using other printing methods.

Generally, the inkjet printing apparatus includes: a carriage (CR) including a print head and an ink tank; a transport means for transporting a printing medium; and a control device for controlling these components. According to this print method, a print head in which ink droplets are ejected through a plurality of minute ejection ports is subjected to the serial scan in a direction (main scanning direction) orthogonal to a printing medium transport direction (sub-scanning direction) and, when no print operation is performed, a printing medium is intermittently transported by an amount equal to a printing width. This printing method ejects ink on a printing medium depending on a printing signal. Thus, this printing method has been widely used as a method that achieves a low running cost and that is quiet.

However, in the case of the inkjet printing apparatus, when ink is allowed to fly through the respective ejection ports of the print head, the solvent in the ink evaporates over time depending on ink environment conditions near the respective ejection ports. Due to this, the neighborhood of an ejection port through which ink should be ejected first has ink of an increased viscosity and thus has a difficulty in ink ejection. If the circumstance as described above is combined with an extended time during which no ejection is performed because ink components having an increased density must be sucked and recovered without being exchanged, the next printing may be prevented from having a normal ejection to eject ink for printing. Regarding this, the maximum time during which a stable ejection can be guaranteed to the no-ejection time under a certain environment (temperature, humidity) (hereinafter also may be referred to as a stable ejection time) is used as one parameter showing the inkjet print head performance.

However, there has been recently a trend in which, in order to realize a further higher printing performance, ink is also required to provide a higher performance such as a higher color formation or high weather resistance. Thus, more inks include a higher amount of functional additives. However, the increased amount of these additives frequently causes an increased ink density or an increased density increase rate due to water evaporation, thus causing a disadvantage of a reduced stable ejection time. Furthermore, a further longer stable ejection time is required when the printing must be carried out with a long travel distance of the print head. For example, a longer stable ejection time is required with an increase of the travel of the print head in the main scanning direction from the A4 size through A3 size and A2 size to A1 size. In such a case, some inks or print heads may cause the stable ejection time to be shorter than the time required for one scanning (hereinafter referred to as a scan time).

Conventionally, several suggestions have been made to increase this stable ejection time by a nozzle structure of a print head, an ink composition, a main body mechanism, or a sequence. For example, there has been a conventional technique to reduce the time from a preliminary ejection to the printing by performing the preliminary ejection on a platen. However, the preliminary ejection can be performed only at limited positions on the platen from the viewpoints of the prevention of offsetting by avoiding ribs or the prevention of mist from being attached to a printing medium for example. Thus, this technique may not provide a sufficient effect. Another method is also considered by which the avoidance is achieved by increasing the travel speed of the print head in the main scanning direction.

In the case of this method however, image formation requires not only the increased travel speed of the print head but also a correspondingly-increased driving frequency at which ink is ejected through the print head. Thus, this method is limited from the viewpoints of the ejection pulse width and the ink refill speed for example.

In order to solve the disadvantage as described above, Japanese Patent Laid-Open No. 2007-144698 discloses a technique according to which an evaporation promotion mechanism is provided to humidify the neighborhood of the ejection port surface so that the stable ejection time can be increased. The evaporation promotion mechanism of Japanese Patent Laid-Open No. 2007-144698 is fixedly provided at the outer side of the platen. In this case, the humidification effect can be obtained only when the paper passes above the evaporation promotion mechanism, thus finding a difficulty in the optimization depending on the size of a printing medium. For example, in the case of a center paper feeding, some printing medium size requires a long distance between the printing region and the evaporation promotion mechanism. Thus, when the print head travels along this long distance, water in the ink normally evaporates, thus causing a disadvantage of a reduced humidification effect as a whole.

Furthermore, Japanese Patent Laid-Open No. 2007-144698 requires the evaporation promotion mechanism not directly contributing to the printing operation and the necessity for an ink tank for evaporation liquid, thus causing disadvantages such as an increased body size and an increased cost for example. Furthermore, when waste ink is used as evaporation liquid, the evaporation promotion mechanism can be provided only beside the home-side cap, thus failing to provide a humidification effect during a back scanning.

SUMMARY OF THE INVENTION

In view of the above, it is an objective of the present invention to provide an inkjet printing apparatus by which, even under an environment where water in ink easily evaporates (e.g., high temperature and low humidity), the ambience near the nozzle can be humidified by the control depending on the temperature and humidity or the printing mode so that a high-quality printing can be achieved while reducing the increase of the waste ink amount and the cost.

Thus, the inkjet printing apparatus of the invention of this application includes: a printing unit for performing printing by ejecting ink while scanning a printing medium;

a platen absorber that is provide at a position opposed to the printing unit, that guides and supports the printing medium, and that can accept the ink ejected from the printing unit; and a control device that determines, upon receiving information instructing printing, a region of the platen absorber to which ink is to be ejected from the printing unit based on information regarding a size of the printing medium to be transport next and that controls, prior to the transportation of the printing medium, the printing unit so that ink is ejected to the region of the platen absorber determined by the determination means.

According to the present invention, the platen absorber of inkjet printing apparatus humidifies the space scanned by the printing unit by allowing ink ejected from the printing unit not contributing to printing to evaporate. Thus, such an inkjet printing apparatus can be realized by which, even under an environment in which water in ink easily evaporates (e.g., high temperature and low humidity), the ambience near the nozzle opening can be humidified by the control depending on the temperature and humidity or the printing mode, thus realizing a high-quality printing while reducing the amount of waste ink and cost.

Further features of the present invention will become apparent from the following description of exemplary embodiments (with reference to the attached drawings).

BRIEF DESCRIPTION OF THE DRAWINGS

FIG. 8 illustrates a table included in the printing apparatus of the first embodiment;

FIG. 9 illustrates a table regarding the printing mode included in the printing apparatus of the first embodiment;

DESCRIPTION OF THE EMBODIMENTS

The following section will describe the first embodiment of the present invention with reference to the drawings.

<Description of Inkjet Printing Apparatus>

Figure 1:
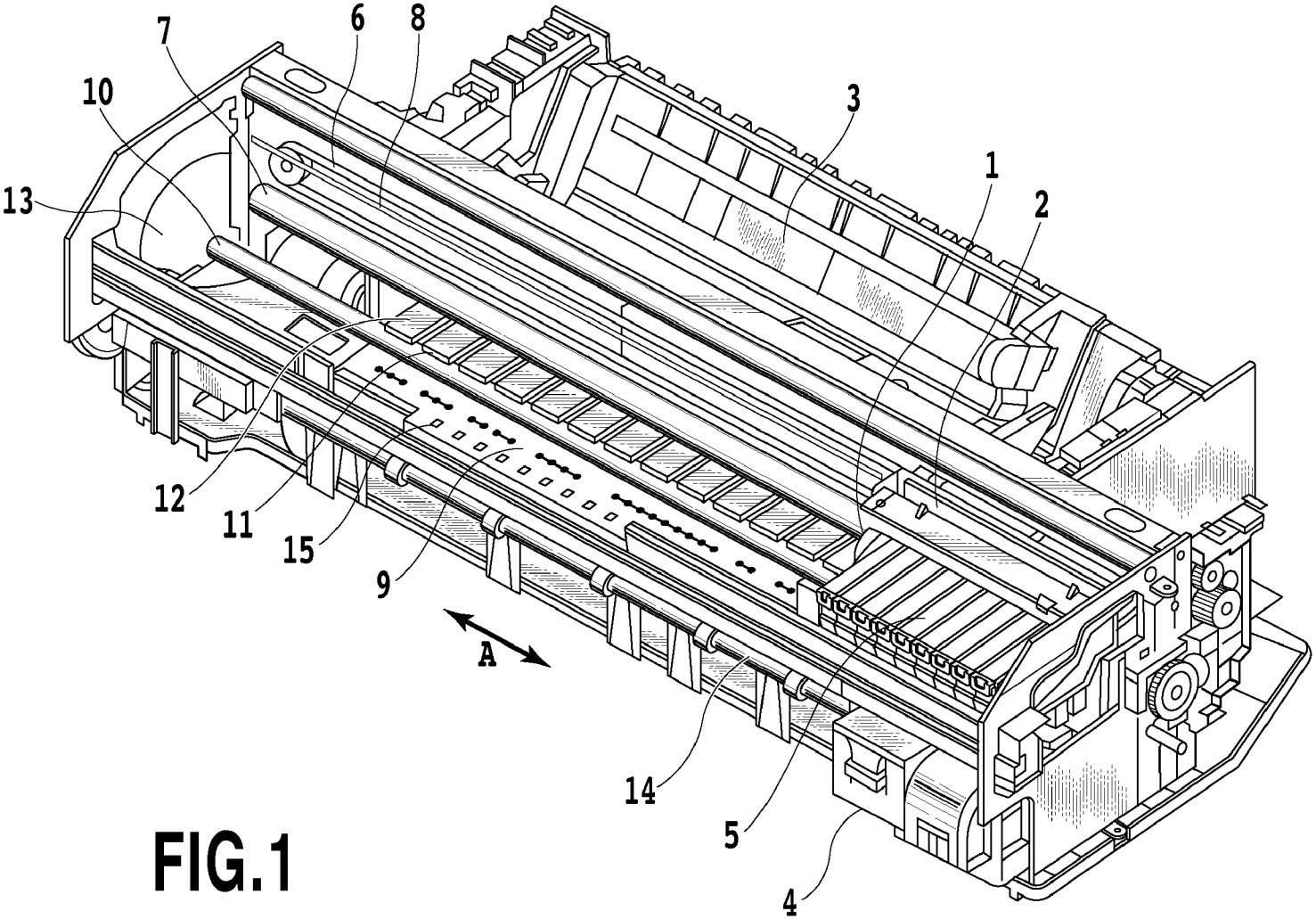
FIG. 1 is a perspective view illustrating the appearance of an inkjet printing apparatus to which the first embodiment can be applied.

FIG. 1 is a perspective view illustrating the appearance of the inkjet printing apparatus to which this embodiment can be applied (hereinafter also may be referred to as a printing apparatus). The inkjet printing apparatus is structured so that a print head 1 is provided in a carriage 2. The print head 1 uses an inkjet method according to which printing is performed by ejecting ink to a printing medium. The carriage 2 including the print head 1 as a printing unit in the inkjet printing apparatus receives a driving force generated by a carriage motor (not shown) to thereby reciprocate the carriage 2 in the direction shown by the arrow A.

A printing medium such as a printing paper for example is fed together with the carriage 2 via a paper feeding mechanism 3 and is transported to a printing position. Then, printing is carried out by ejecting ink to the printing medium at the printing position through the print head 1. In order to maintain the favorable status of the print head 1, the carriage 2 is moved to the position of the recovery apparatus 4 to thereby intermittently subject the print head 1 to the ejection recovery processing. The carriage 2 of the printing apparatus includes not only the print head 1 but also the ink cartridge 5 for storing ink to be supplied to print head 3. The ink cartridge 5 is detachably attached to the carriage 2.

The printing apparatus shown in FIG. 1 can perform a color printing. Thus, the carriage 2 includes ten ink cartridges that include therein pigment inks of cyan (C), light cyan (Lc), magenta (M), light magenta (Lm), yellow (Y), photo black (Pbk), mat black (Mbk), red (R), green (G), and gray (Gray), respectively. These ten ink cartridges can be attached or detached independently.

The carriage 2 and the print head 1 are structured so that the joint surfaces thereof can be appropriately abutted to each other to thereby achieve and maintain a necessary electric connection. The print head 1 applies energy depending on a printing signal to thereby selectively eject ink from among a plurality of ejection ports to perform printing. In particular, the print head 1 of this embodiment uses such an inkjet method according to which ink is ejected using thermal energy. The print head 1 includes an electric thermal converter for generating thermal energy. Electric energy applied to the electric thermal converter is converted to thermal energy. Then, the thermal energy is given to ink to thereby cause the growth of bubbles and a pressure change due to constriction by which ink is ejected through the ejection port. This electric thermal converter is provided to correspond to each of the respective ejection ports and applies, depending on a printing signal, a pulse voltage to the corresponding electric thermal converter to thereby eject ink through the corresponding ejection port.

The carriage 2 is connected to a part of the driving belt 6 for transmitting the driving force of the carriage motor. The carriage 2 is configured so as to be guided and supported so that the carriage 2 can be slid along a guide shaft 7 in the direction shown by the arrow A. Thus, the carriage 2 reciprocates along the guide shaft 7 by the forward and reverse rotations of the carriage motor.

An encoder 8 is provided along the moving direction of the carriage 2 (the direction shown by the arrow A). The encoder 8 is used to show the absolute position of the carriage 2. In this embodiment, the encoder 8 is made of a transparent PET film on which black bars are printed with required pitches. One side of the encoder 8 is fixedly attached to a chassis (not shown) and the other side thereof is supported by a plate spring (not shown). The printing apparatus includes a platen 9 that is opposed to an ejection port face including the ejection port (not shown) of the print head 1.

Simultaneously with the reciprocation of the carriage 2 by the driving force of the carriage motor, a printing signal is given to the print head 1 to eject ink, thereby providing printing to the entire width of the printing medium transported on the platen.

A transport roller 10 is driven by a transport motor (not shown) in order to transport a printing medium. A pinch roller 11 uses a spring (not shown) to abut the printing medium to the transport roller 10 and is rotatably supported by a pinch roller holder 12. A transport roller gear 13 is fixedly attached to one end of the transport roller 10. The transport roller 10 is driven by the rotation of the transport motor transmitted from the transport roller gear 13 via an intermediate gear (not shown). A discharge roller 14 is a roller that discharges the printing medium on which an image is formed by the print head 1 to the exterior of the printing apparatus. The discharge roller 14 is driven by receiving the rotation of the transport motor.

The discharge roller 14 is abutted to the printing medium by a spur roller (not shown) that is abutted to the printing medium by a spring (not shown). A spur holder 15 supports the spur roller in a rotatable manner. The printing apparatus includes a recovery apparatus 4 for recovering the defective ejection of the print head 3. The recovery apparatus 4 is provided at a desired position at the outside of the reciprocating motion range (or at the outside of the printing region) for the printing operation by the carriage 2 including the print head 1 (e.g., a position corresponding to the home position).

Figure 2:
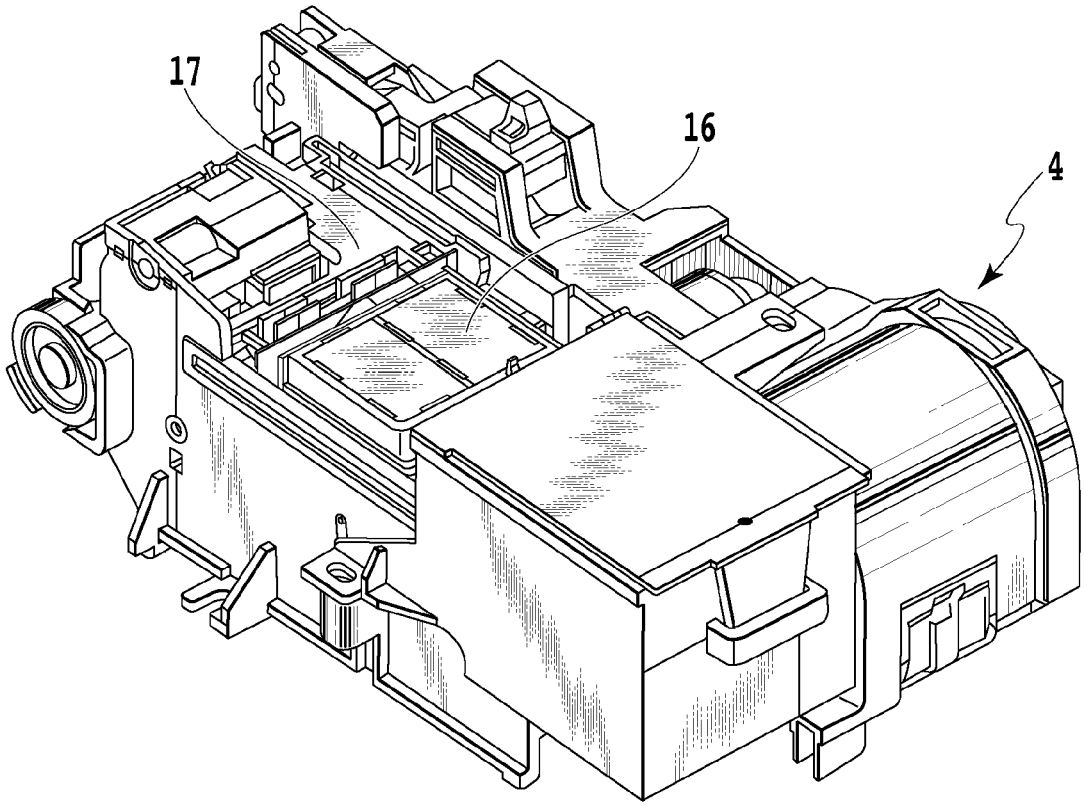
FIG. 2 is a perspective view illustrating a recovery mechanism.

FIG. 2 is a perspective view illustrating the recovery mechanism 4. The recovery apparatus 4 includes: a capping mechanism 16 for capping the ejection port face of the print head 1; and a wiping mechanism 17 for cleaning the ejection port face of the print head 1. The recovery apparatus 4 uses, in coordination with the capping of the ejection port face by the capping mechanism 16, a suction means (e.g., a suction pump) in the recovery apparatus to forcedly discharge ink through the ejection port, thereby performing an ejection recovery processing for removing ink having an increased viscosity in the ink flow path of the print head 1 or bubbles for example. When no printing operation is performed for example, the ejection port face of the print head 1 can be capped by the capping mechanism 16 to thereby protect the print head 1 and to prevent ink from evaporating or drying.

On the other hand, the wiping mechanism 17 is provided in the vicinity of the capping mechanism 16 and wipes off the ink droplets attached to the ejection port face of the print head 1. The capping mechanism 16 and the wiping mechanism 17 can be used to maintain the proper ink ejection status of the print head 1.

<Temperature and Humidity Sensor>

The following section will describe a temperature sensor and a humidity sensor attached to the print head 1. In this embodiment, a sensor senses the temperature and humidity at the neighborhood of the print head (or the neighborhood of the printing unit). The temperature sensor is a diode sensor that is provided on a substrate used in the print head 1 (hereinafter referred to as a print head substrate). Since it is difficult to directly detect the ink temperature, the temperature of the print head substrate (hereinafter referred to as a print head temperature) is generally detected and is used as an ink temperature. A configuration for detecting the print head temperature is not limited to the diode sensor and also may use a metal film sensor for example.

The humidity sensor is a hygrometer that uses hygroscopic substance such as lithium chloride, ceramics, or polymer to measure a change in the amount of water vapor as an electrical change such as an electrical resistance or capacitance. However, the temperature sensor and the humidity sensor are not limited to the above ones. The substrate used for the carriage 2 (hereinafter referred to as a carriage substrate) has thereon an attached thermistor so that an environment temperature can be read. In the case of an inkjet printing apparatus not including a diode sensor, the environment temperature also may be used.

The term "humidity" used in this embodiment means a relative humidity and is defined by the following formula.

$$Uw = xv/xvs \times 100 = e/es \times 100 \approx e/ew \times 100V$$

V: humid air volume

T, t: Humid air temperature

T: Humid air temperature (absolute temperature)

t: Humid air temperature (Celsius' temperature)

mv: Mass of water vapor in humid air es: Water vapor pressure of saturated humid air ew: Saturated vapor pressure of water xv: Mole fraction of water in saturated humid air XVS: Mole fraction of water in saturated humid air <Platen>

The following section will describe the platen 9. The platen 9 is opposed to the print head 1 to have a predetermined space therebetween. The platen 9 has, at the center thereof, a groove that extends in the scanning direction of the print head 1 (the direction shown by the arrow A). This groove includes an absorber made of MAPS (porous material) for example embedded therein. Thus, this groove can accept the ink ejected from each nozzle of the print head 1. In this embodiment, a platen 9 is provided in opposite to an ejection port face of the print head 1 during printing, and at the back side of the printing medium. And the absorber is integral with the platen 9. In this specification, the absorber is called platen absorber and shown in FIG. 3. Also, this absorber may be sponge and may also be material that is able to hold liquid. The platen 9 also has, at the center thereof, an ink lead-out path that extends in the downward direction. This waste ink storage part is also made of such material that can absorb and store therein ink such as porous material. This waste ink storage unit and a platen absorber provided above the waste ink storage unit constitute an ink absorbing unit.

Figure 3:
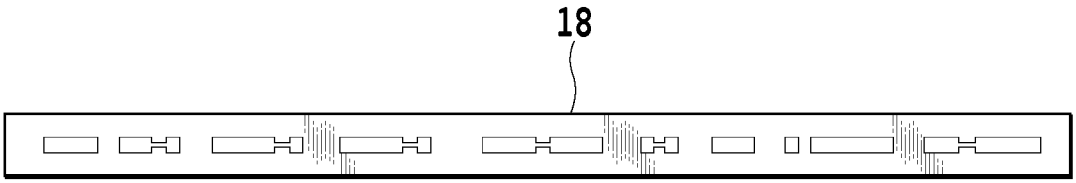
FIG. 3 illustrates the platen absorber of the inkjet printing apparatus of FIG. 1.

FIG. 3 illustrates a platen absorber 18 of the inkjet printing apparatus to which this embodiment can be applied. The platen absorber 18 extends along the scanning direction of the print head 1 (the direction shown by the arrow A) in the platen 9 so that the platen absorber 18 extends from one end of the platen 9 to the other end. Thus, the ink ejected from the print head 1 can be generally received by the platen absorber 18.

In the ink absorbing unit having the configuration as described above, ink ejected to the upper face of the platen absorber 18 by a preliminary ejection during printing or a marginless printing for example is absorbed by the capillary action of the platen absorber 18. Then, the ink absorbed by the platen absorber 18 is allowed to drip into the waste ink storage unit at the lower side via the ink lead-out path and is retained therein.

<Control Configuration>

Figure 4:
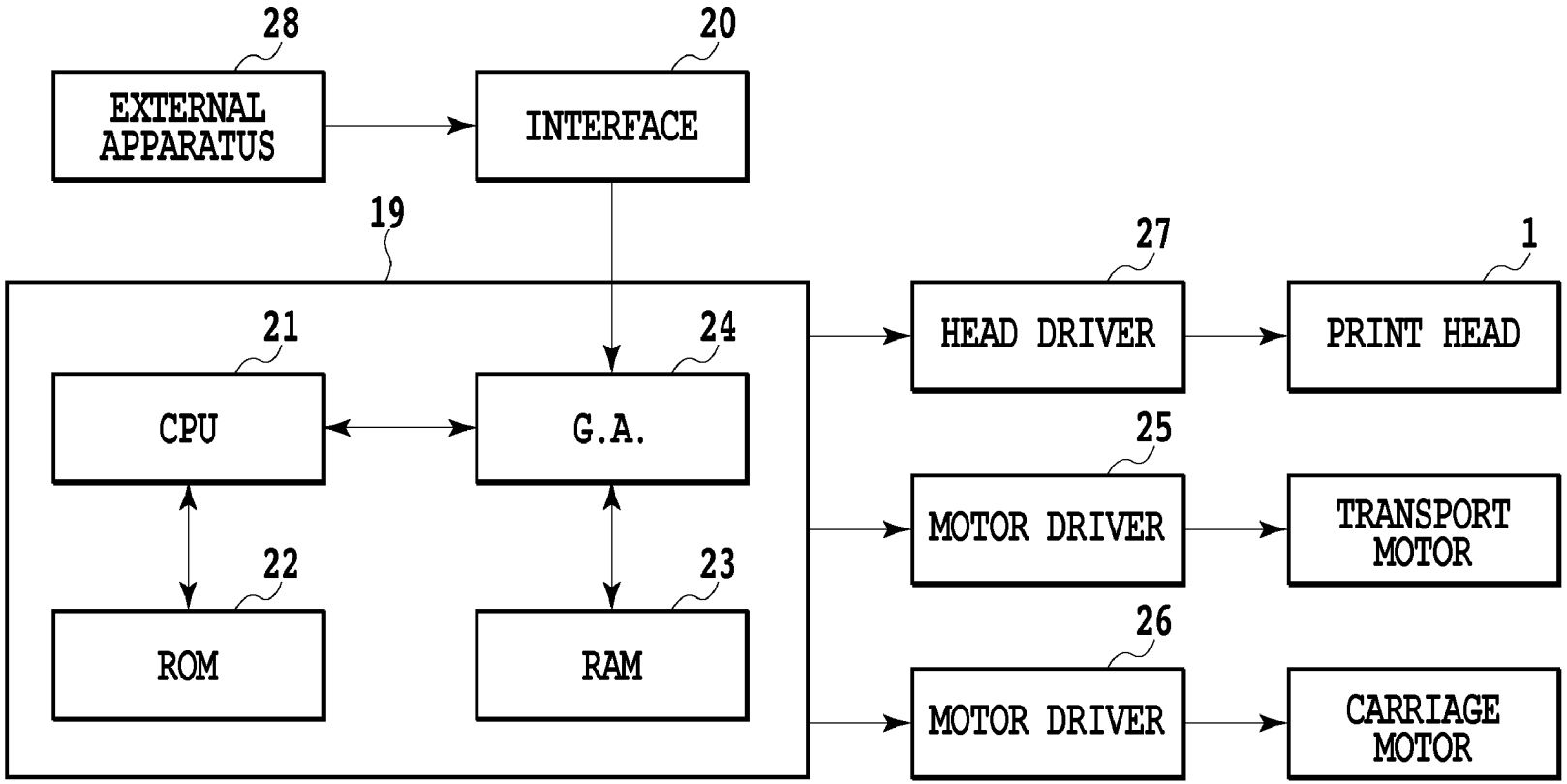
FIG. 4 is a block diagram illustrating the control configuration of the inkjet printing apparatus shown in FIG. 1.

FIG. 4 is a block diagram illustrating the control configuration of the inkjet printing apparatus shown in FIG. 1. A main body the control circuit 19 includes a CPU 21, a gate array (G. A.) 24, an RAM 23, and an ROM 22. An interface 20 is used to input image data from the external apparatus 28. The ROM 22 stores therein a control program to be executed by the CPU 21. The RAM 23 stores therein various pieces of data (e.g., image data, a printing signal to be supplied to the print head). Functionally, apart of the RAM 23 is allocated as an image memory (which will be described later). The gate array (G.

A.) 24 controls the supply of a printing signal to the print head 1 and also controls the data transfer among the interface 20, the CPU 21, and the RAM 23. Motor drivers 25 and 26 are a driver to drive the transport motor and the carriage motor, respectively.

The following section will describe the operation of the control configuration. When image data is inputted to the interface 20, the image data is converted to a printing signal between the gate array 24 and the CPU 21. Then, the motor drivers 25 and 26 are driven and the print head 1 is driven in accordance with the printing signal sent to the head driver 27 to thereby perform printing.

Figure 5:
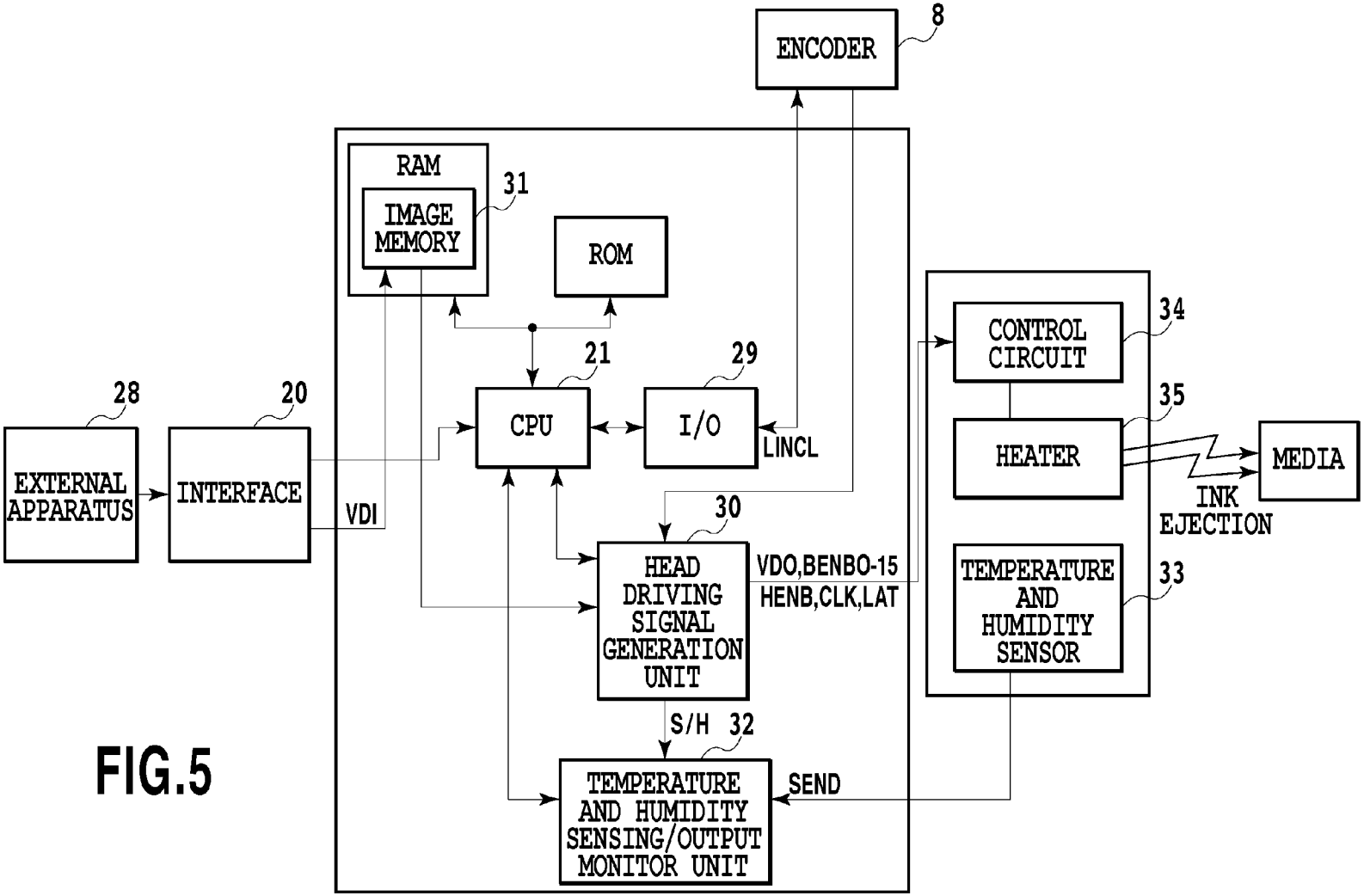
FIG. 5 is a block diagram illustrating the configuration of the detection of the temperature and humidity according to the control configuration of FIG. 4.

FIG. 5 is a functional block diagram illustrating, in further detail, the configuration according to the detection of the temperature and humidity of the print head 1 in the control configuration shown in FIG. 4. A control circuit 19 uses, based on the image data (VDI) transferred from an external apparatus 28 such as an image scanner, a personal computer, or CAD, the print head 1 to generate a signal required to perform a control to print an image on a printing medium. The main body the control circuit 19 includes, in addition to the CPU 21, the RAM 23, and the ROM 22 described above, an interface (I/O) 29 to the encoder 8 and functional components of a head driving signal generation unit 30, an image memory 31, and a temperature and humidity sensing/output monitor unit 32.

The temperature and humidity sensing/output monitor unit 32 includes therein an A/D converter to convert the analog output signal (SEND) from the temperature and humidity sensor 33 of the print head 1 to a digital signal. On the other hand, the print head 1 is composed of a head control circuit 34, a heater unit 35, and the temperature and humidity sensor 33. The CPU 21 receives, via the interface 20, the image data (VDI) serially transferred from the external apparatus 28. The CPU 21 controls the operation of the entire printing apparatus including the respective memories or an I/O unit for example.

When the CPU 28 receives the image data (VDI) serially transferred from the external apparatus 28, the CPU 28 instructs the head driving signal generation unit 30 to temporarily store the image data (VDI) in an amount corresponding to a several scannings for printing. The retained image data (VDI) is subjected to various image processings and the image data (VDO) is outputted to the print head 1 in accordance with the scanning by the carriage 2. In the configuration shown in FIG. 4, the function of the head driving signal generation unit 30 is achieved by the head driver 27 and the gate array 24. In order to achieve this function, an ASIC also may be provided in the main body control circuit 19.

In this embodiment, an encoder signal (LINCL) outputted from the encoder 8 in synchronization with the scanning by the carriage 2 is used to synchronize the respective controls such as the output of the image data (VDO). In the head driving signal generation unit 30, enable signals (BENB0 to 15) to the respective blocks of the print head 1 and a signal required for ink ejection such as a heater driving signal (HENB) are also generated. The image signal (VDO), the enable signals (BENB0 to 15), the heater driving signal (HENB) for example outputted from the head driving signal generation unit 30 are transferred to the head control circuit 34 of the print head 1. Then, in the print head 1, only a heater of a printing element selected based on the enable signals (BENB0 to 15), the heater driving signal (HENB), and the image signal (VDO) is turned ON and ink is ejected to thereby form an image on the printing medium.

<Humid Sequence>

In this embodiment, ink not contributing to printing is ejected to the platen absorber 18 to thereby cause the platen absorber 18 to absorb water so that water evaporated from the platen absorber 18 is used to humidify the ambience around the platen absorber 18. Then, the humidified ambience is used to humidify the nozzle of the print head to thereby suppress an ejection defect or an ejection failure.

Figure 6:
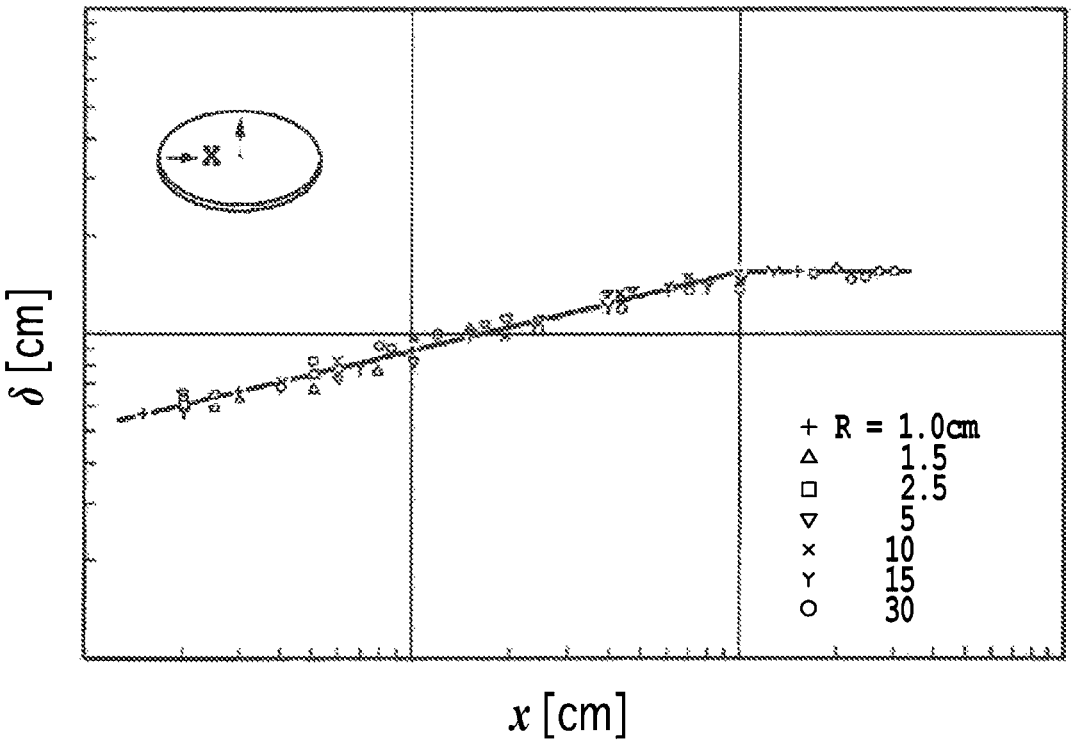
FIG. 6 is a graph illustrating the relation between the diffusion layer of the platen evaporation face and the distance from the center to an end.

FIG. 6 illustrates the relation between the thickness δ of the diffusion layer of the evaporation face facing upwardly in the horizontal direction in the platen absorber 18 and the distance x from the center to an end in the region including water. As can be seen, an increase of the distance x from the center to the end in the region including water causes an increase of the thickness δ of the diffusion layer near the center. This shows that the diffusion layer can have an increased thickness by supplying water in a wider range of the platen absorber 18, thus resulting in increased opportunities for humid ambience to touch the neighborhood of the nozzle opening.

Figure 7:
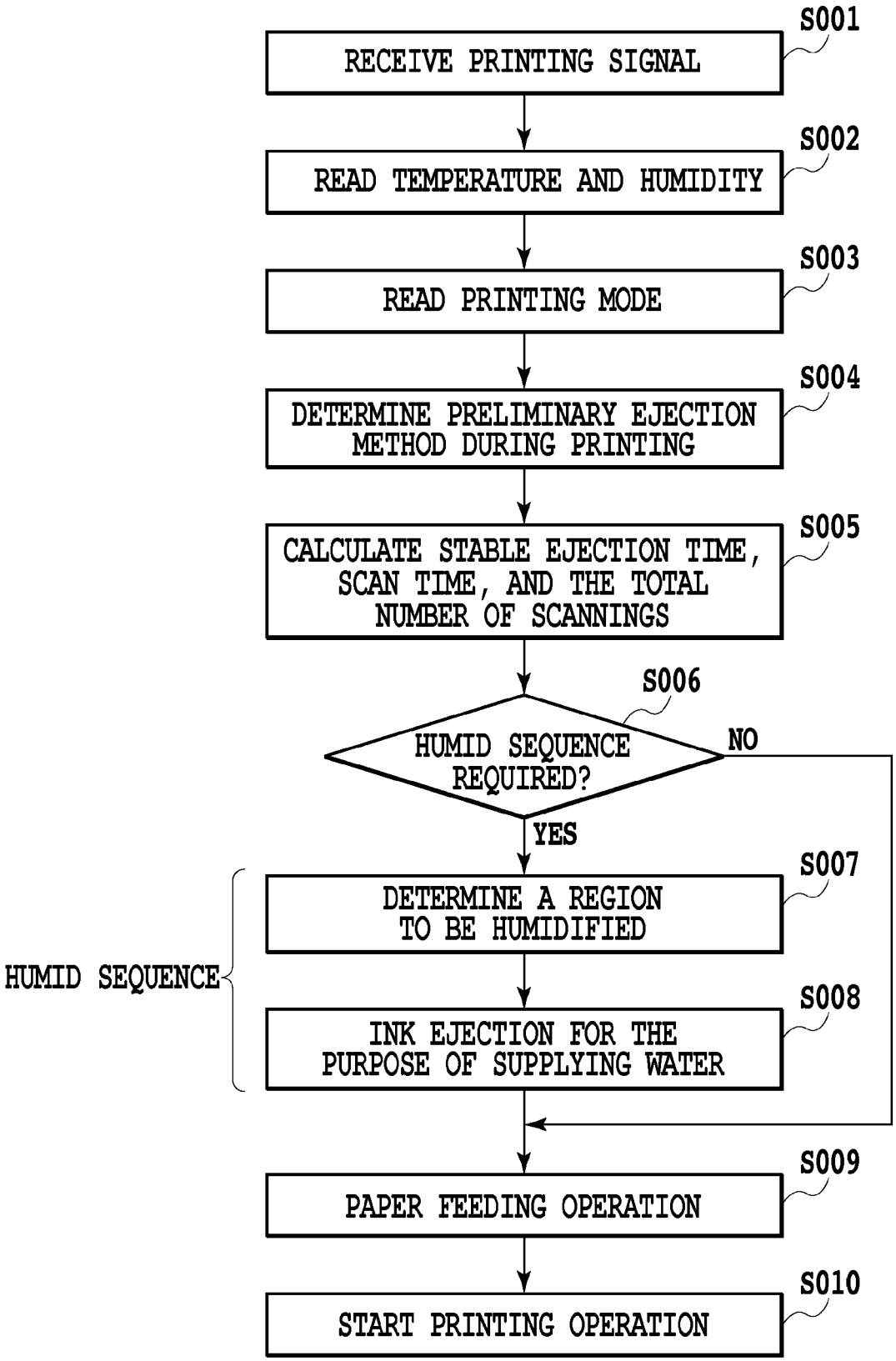
FIG. 7 is a flowchart illustrating the printing operation in the first embodiment.

FIG. 7 is a flowchart illustrating the printing operation in this embodiment. The following section will describe, based on this flowchart, an embodiment of the humid sequence in the present invention. First, the entire flow will be described. First, when a printing signal is received in Step S001, then the value of the temperature and humidity sensor is read in Step S002. Next, the printing mode is read in Step S003. In Step S004, the preliminary ejection method during printing is determined. In Step S005, the stable ejection time, the scan time, and the total number of scannings are calculated. In Step S006, the necessity of the humid sequence in the present invention is determined. When the humid sequence is required in Step S006, the processing proceeds to Step S007 to determine a region to be humidified. In Step S008, ink ejection for humidification is performed. After the completion of the ink ejection, a paper feeding operation is performed in Step S009. In Step S010, a normal printing operation is performed. If Step S006 shows that no humid sequence is required, the processing proceeds to Step S009 to perform a paper feeding operation. In Step S010, a normal printing operation is performed.

The following section will describe in detail the respective steps of the above humid sequence.

Step S001 (Reception of a Printing Signal)

In this step, whether a printing signal is received or not is determined. When there is no input of a printing signal, the capping is performed by the suction recovery cap of the capping mechanism 16 provided in the recovery apparatus 4. When there is an input of a printing signal, the following control is performed.

Step S002 (Reading of Temperature and Humidity)

FIG. 8 illustrates a table owned by the printing apparatus of this embodiment. The temperature and humidity sensor of the print head 1 senses the temperature and humidity.

Based on the detection result, the table of FIG. 8 is referred to thereby calculate a stable ejection time. In FIG. 8, the stable ejection time of the yellow ink (Ye) is shown. The yellow ink (Ye) has the shortest stable ejection time in this embodiment. When the table of FIG. 8 is referred to, the stable ejection time corresponding to the temperature of 30 degrees C. and the humidity of 10% is 1.0 second for example. Although the print head temperature (diode sensor value) is referred to as a temperature, the environment temperature (thermistor value) also may be referred to.

Step S003 (Reading of Printing Mode)

FIG. 9 illustrates a table regarding the printing mode owned by the printing apparatus of this embodiment. Based on the printing signal sent from the driver, such a printing mode is referred to that includes information such as the size of the printing medium as well as the type of the printing medium and the printing quality as shown in FIG. 9, thereby determining the control method of the preliminary ejection during printing. Information regarding a size of print medium includes at least information regarding width in a scanning direction of the print head. In this embodiment, the preliminary ejection is driven at a frequency of 9 kHz. Thus, 9 preliminary ejections per 1 nozzle are performed to a preliminary ejection receiver (which will be described later).

Step S004 (Determination of a Preliminary Ejection Method During Printing)

The following section will describe the timing at which the preliminary ejection is performed. The preliminary ejection during printing is performed at the timing at which the carriage returns and at a predetermined position when a certain ink satisfies the following formula (1).

$$\text{(Elapsed time since the preliminary ejection)} > \text{(stable ejection time)} - \text{(scan time)} \quad (1)$$

When a printing medium of an A3 size is printed for example, the preliminary ejection during printing is performed to the left and right caps as well as the preliminary ejection receiver per one scanning. In this embodiment, the maximum operating width of the carriage during printing is 480 mm. In this embodiment, all inks are subjected to the preliminary ejection at the same timing as that of the yellow ink (Ye) having the shortest preliminary ejection cycle. However, inks of other colors also may be subjected to the preliminary ejection at the same timing as that of the yellow ink (Ye) or also may be subjected to the preliminary ejection at different timings satisfying the formula (1), respectively.

Step S005 (Calculation of a Stable Ejection Time, a Scan Time, and the Total Number of Scannings Based on the Printing Mode)

Figure 10:
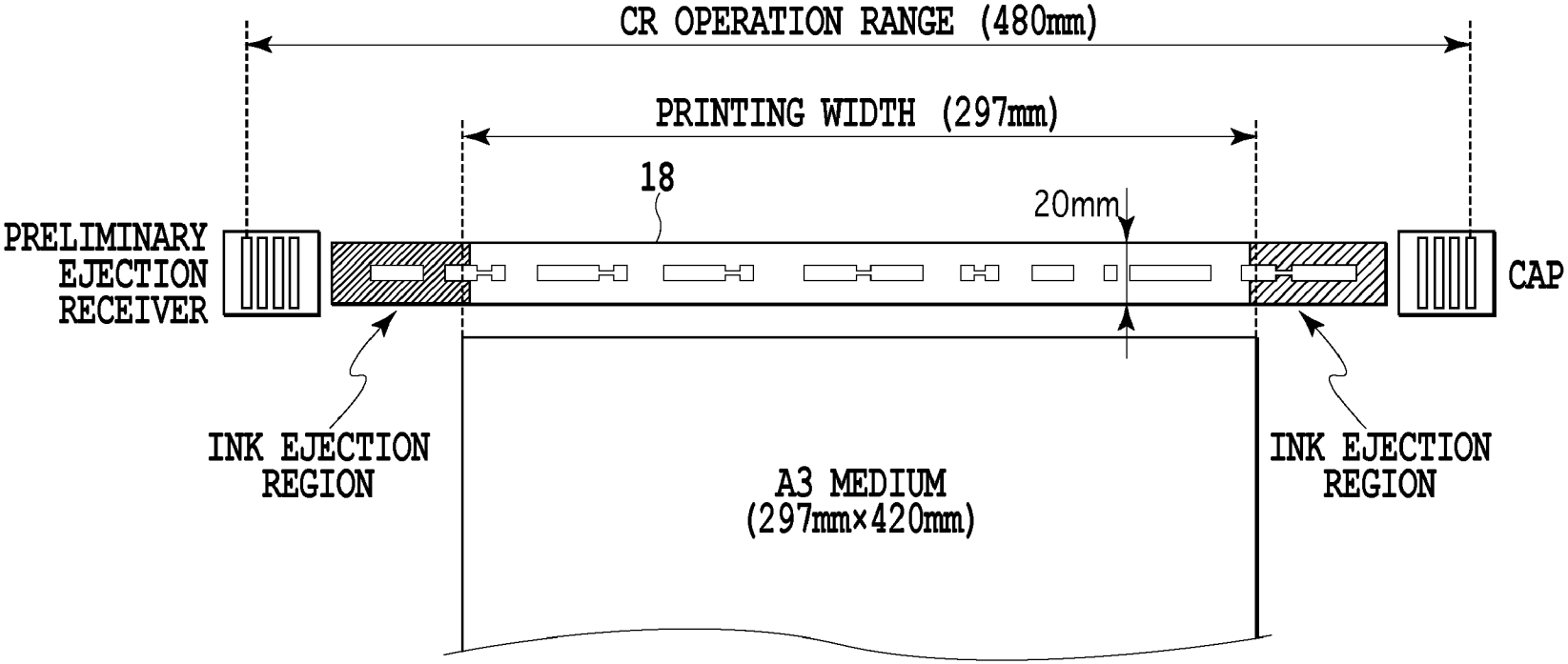
FIG. 10 is a top view illustrating a part near the platen absorber of the inkjet printing apparatus.
Figure 11:
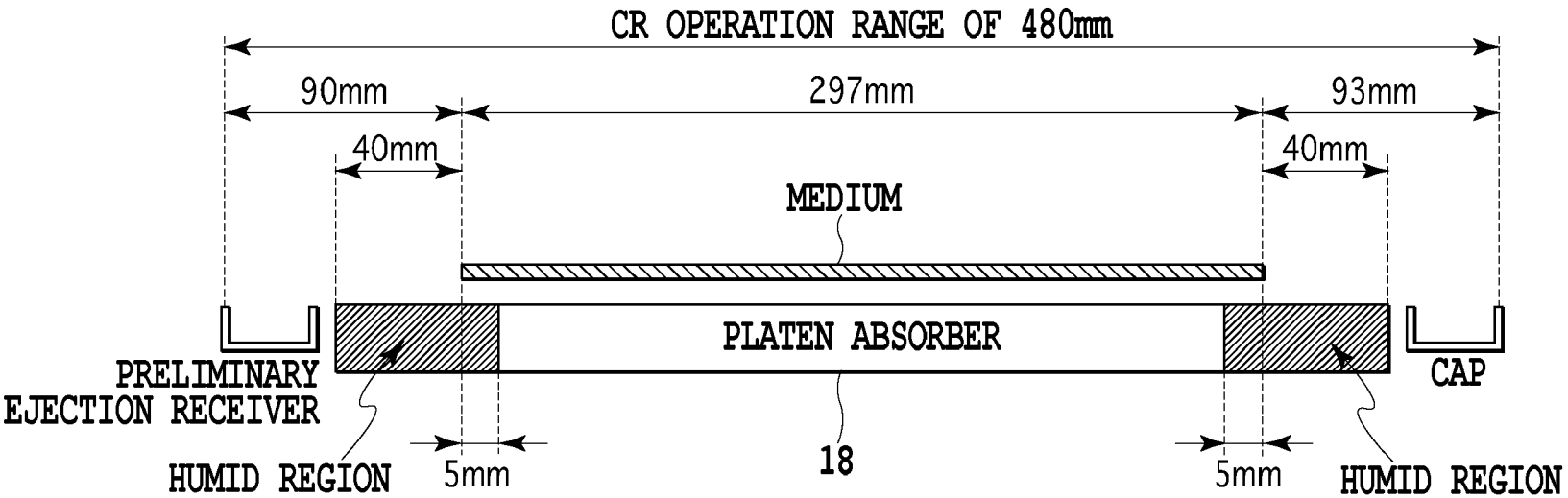
FIG. 11 is a side view illustrating a part near the platen absorber of the inkjet printing apparatus.

Based on the printing mode including the information such as the read printing medium size, the type of the printing medium, and the printing quality, the time required for one scanning (scan time) and the number of scannings required to complete the printing are calculated. FIG. 10 is a top view of the neighborhood of the platen absorber 18 of the inkjet printing apparatus used in this embodiment. FIG. 11 is a side view of the neighborhood. The inkjet printing apparatus is assumed to have a print head in which 768 nozzles are arranged with an interval of 1200 dpi per 1 nozzle array. In this embodiment, when a special paper of an A3 size (297 mm×420 mm) is printed with "quality 1", the total number of scannings can be generally calculated as: 420 mm÷(25.4 mm÷1200 dpi×768)×16 passes≈413 scannings. When it is assuming that the carriage operating width for printing an A3-size printing medium is 480 mm, the scan time can be generally calculated as: 480 mm÷(25.4 mm×15 inch)+(carriage acceleration and deceleration term)≈1.3 sec.

Step S006 (The Necessity of the Humid Sequence)

In this step, the necessity of the humid sequence is determined based on the stable ejection time, the scan time, and the total number of scannings calculated based on the temperature and humidity as well as printing mode. In this embodiment, the humid sequence is performed when the stable ejection time is shorter than the scan time. However, the conditions for performing the humid sequence are not limited to the above case. For example, when the printing medium size is small and the scan time is shorter than the stable ejection time, such a control is selected so that the minimum amount of ink used for purposes other than a printing purpose is used during printing. Specifically, the humid sequence also may be performed when "(the ink amount used for the humid sequence)+(the preliminary ejection amount during printing when the humid sequence is performed)" is smaller than "the preliminary ejection amount during printing when no humid sequence is performed". When the stable ejection time is longer than the scan time, a normal printing operation is started.

Step S007 (Determination of a Region to be Humidified)

When the stable ejection time is shorter than the scan time, the humid sequence is performed prior to the paper feeding operation. First, a region of the platen absorber 18 to be humidified by the humid sequence is determined. According to the investigation by the present inventor, when a printing medium passes at a level above the humidified platen absorber 18 having a height of about 4 mm from the humidified platen absorber 18, the ambience on the printing medium only can receive an extremely-low effect the humid sequence due to the temperature and humidity of the surrounding environment. Thus, in order to reduce waste ink, ink is preferably ejected to the platen absorber 18 only in a region except for the range within which the printing medium passes. As described above with regard to the thickness of the diffusion layer and the distance from the center, an increase of the ink ejection range causes increased opportunities at which the humidified ambience touches the neighborhood of the nozzle opening. The nozzle of the print head 1 scans the level having a height of about 6 mm from the platen absorber 18. Thus, as the interval between the range within which the printing medium passes and the humid region is closer to zero, a more humidification effect can be provided to the neighborhood of the nozzle opening.

Thus, in this embodiment, ink is ejected not only to a region except for the printing medium passing range among the carriage operation range but also to a part of the range within which the printing medium passes. Specifically, when a print job is received, based on the information regarding the size of the printing medium to be transported next, a region within which ink is ejected to the platen absorber is determined. Then, prior to the transport of the printing medium, ink is ejected to the platen in a range to the inner side of the printing medium passing region. Thus, the humid effect can be obtained even after the transportation of the printing medium.

Figures 12A, 12B:
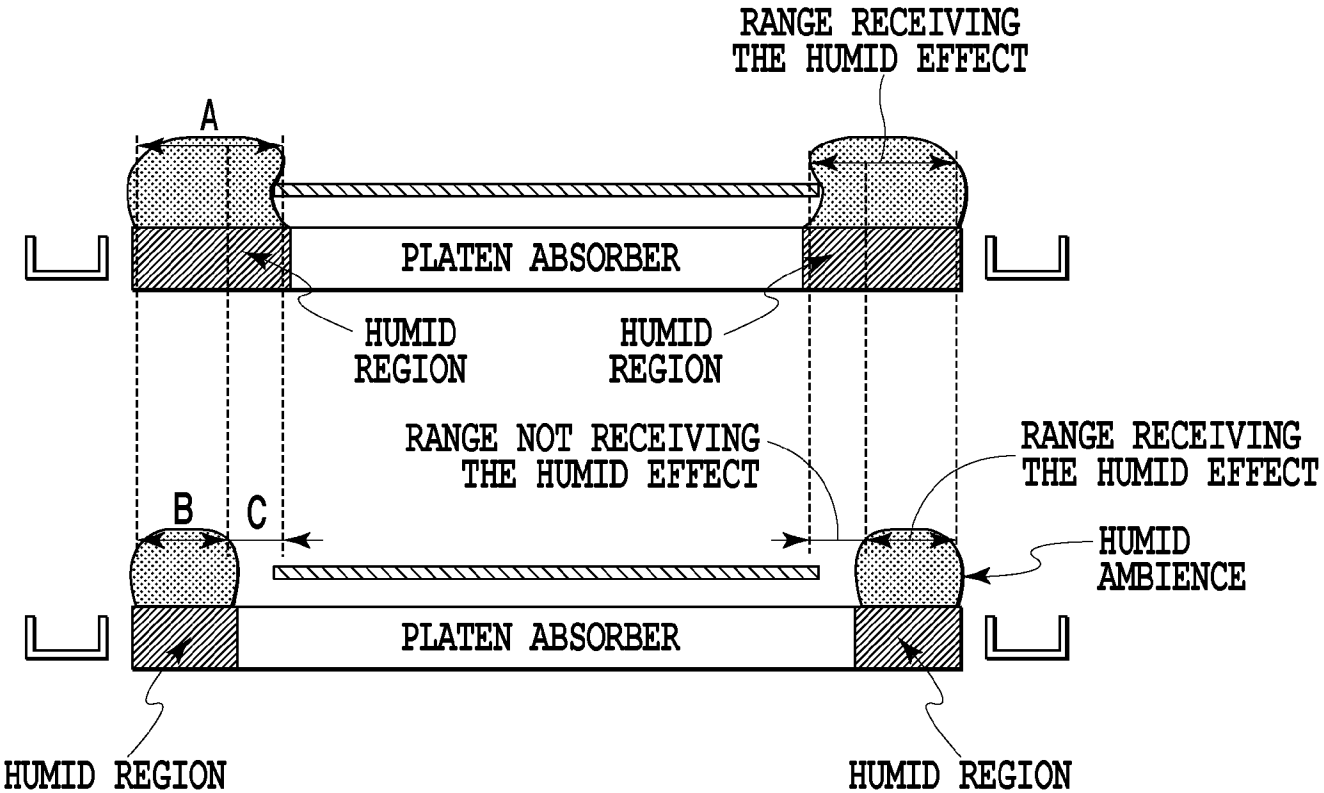
FIG. 12A is a schematic view illustrating the humid region and the humid ambience.
FIG. 12B is a schematic view illustrating the humid region and the humid ambience when the printing medium transport range is away from the humid region.

In this embodiment, ink is ejected to the ranges from the both sides of the printing medium passing range by a distance of 5 mm in an inward direction. The reason of ink ejection to the ranges from the both sides of the printing medium passing range by a distance of 5 mm in an inward direction is to consider a transport error of the printing medium in the carriage operation direction in the inkjet printing apparatus of this embodiment. By doing this, the interval between the printing medium passing range and the humid region can be minimized to be closer to zero as much as possible. FIG. 12A is a schematic view illustrating the humid region and the humid ambience of this embodiment. FIG. 12B is a schematic view illustrating the humid region and the humid ambience when the printing medium transport range is away from the humid region. The dotted line shows the humid ambience. Since the configurations in FIG. 12A and FIG. 12B are generally symmetric in the left and right direction, the following section will describe the humid effect by describing the left configuration.

In the case of FIG. 12A, the carriage is subjected to the humid effect by this sequence when the carriage passes through the humid ambience (i.e., when the carriage passes through the range A). On the other hand, in the case of FIG. 12B, the carriage is similarly subjected to the humid effect when the carriage passes through the range B. However, the carriage is not subjected to the humid effect when the carriage does not pass through the range C because the carriage is out of the humid ambience. The same applies to the right side. Thus, by reducing the interval between the printing medium passing range and the humid region to zero or less as in FIG. 12A, the humid effect can be obtained in a wider range.

By the control as described above, the humid effect can be obtained more efficiently while reducing the amount of unnecessary waste ink caused by the humid sequence. In the case of the center paper feeding mechanism as in this embodiment, as shown in FIG. 12A and FIG. 12B, the regions at both sides of the printing medium passing range can be subjected to the humid sequence to provide the humid effect in a wider range. By performing the ink ejection operation prior to the paper feeding, a desired region including the printing medium passing range can be subjected to the humid sequence while reducing the risk of ink attached to the a printing medium.

Step S008 (Execution of Ink Ejection For Humidification)

To the region of the platen absorber 18 determined in Step S007, ink is ejected in an amount of 0.041 ml per 1 $cm^2$. In this embodiment, ink droplets are ejected in an average amount of 3.2 p1. Thus, this average amount can be converted to the number of ejections of $1.25\times10^7$ ejections per 1 $cm^2$. In this embodiment, the ink ejection range (a part shown by diagonal lines in FIG. 5) is about 18 $cm^2$. Thus, the amount of ink amount used is 0.72 ml ($2.25\times10^8$ ejections).

Figure 13:
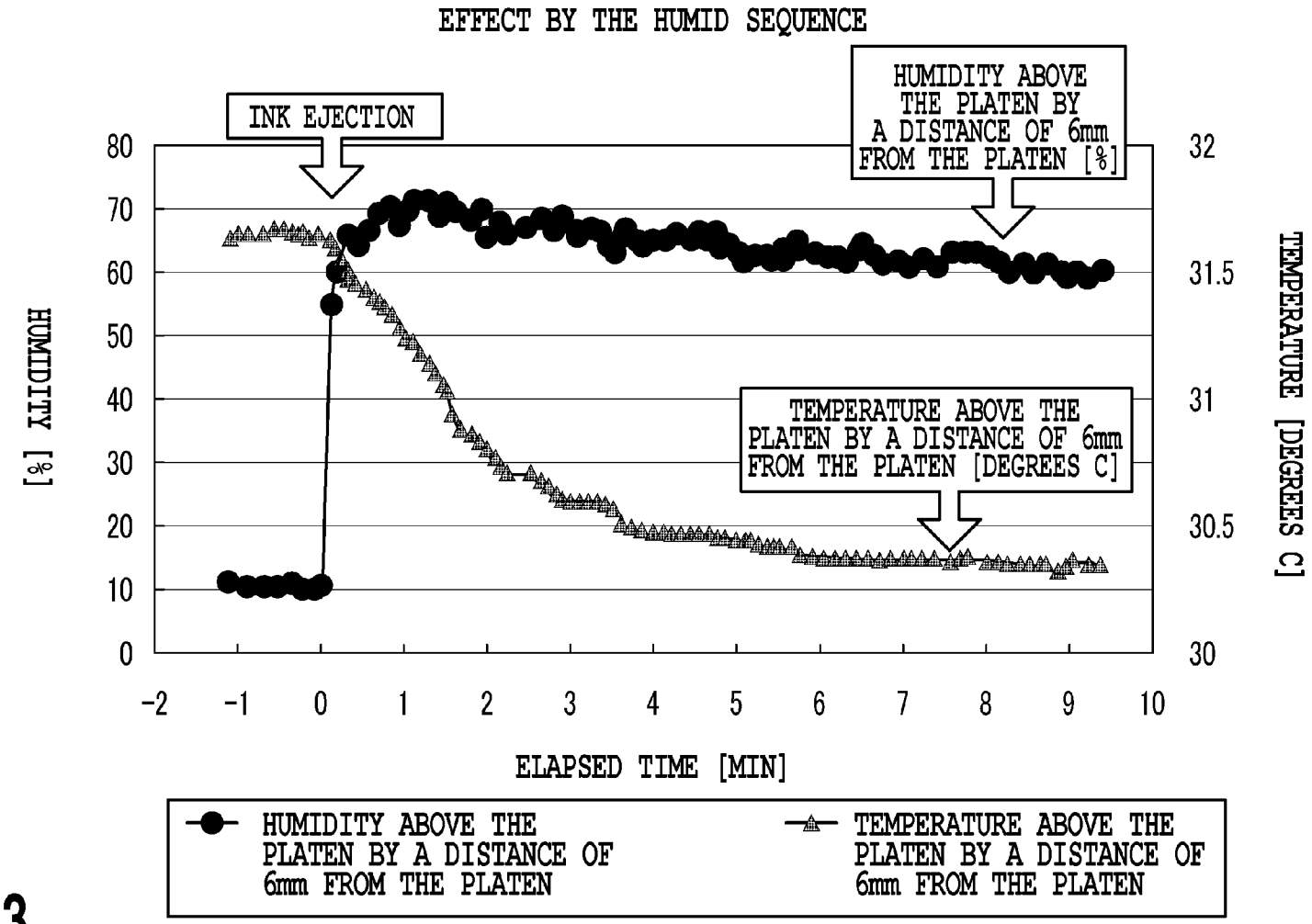
FIG. 13 is a graph illustrating a change in the temperature and humidity in the platen absorber.

FIG. 13 is a graph illustrating a change in the temperature and humidity in the space above the platen absorber 18 by a distance of about 6 mm (hereinafter also may be referred to as an above-platen space) when the humid sequence in this embodiment is carried out. Although the environment humidity was about 10%, the space above the platen subjected to the humid sequence was humidified to about 60%. An additional effect was that evaporation heat is lost to thereby reduce the ambience temperature of the space above the platen to thereby reduce the temperature of the nozzle section (ink ejection section). In this embodiment, when the environment temperature was about 31.7 degrees C., the above-platen space after 3 minutes after the execution of the humid sequence was about 30.6 degrees C. This shows that the reduced temperature also slightly reduces the water evaporation from meniscus. The following section will describe a change in the humidity in the space above the platen absorber 18 from the distance of about 6 mm from the platen absorber 18 immediately after the start of the humid sequence.

Figure 14:
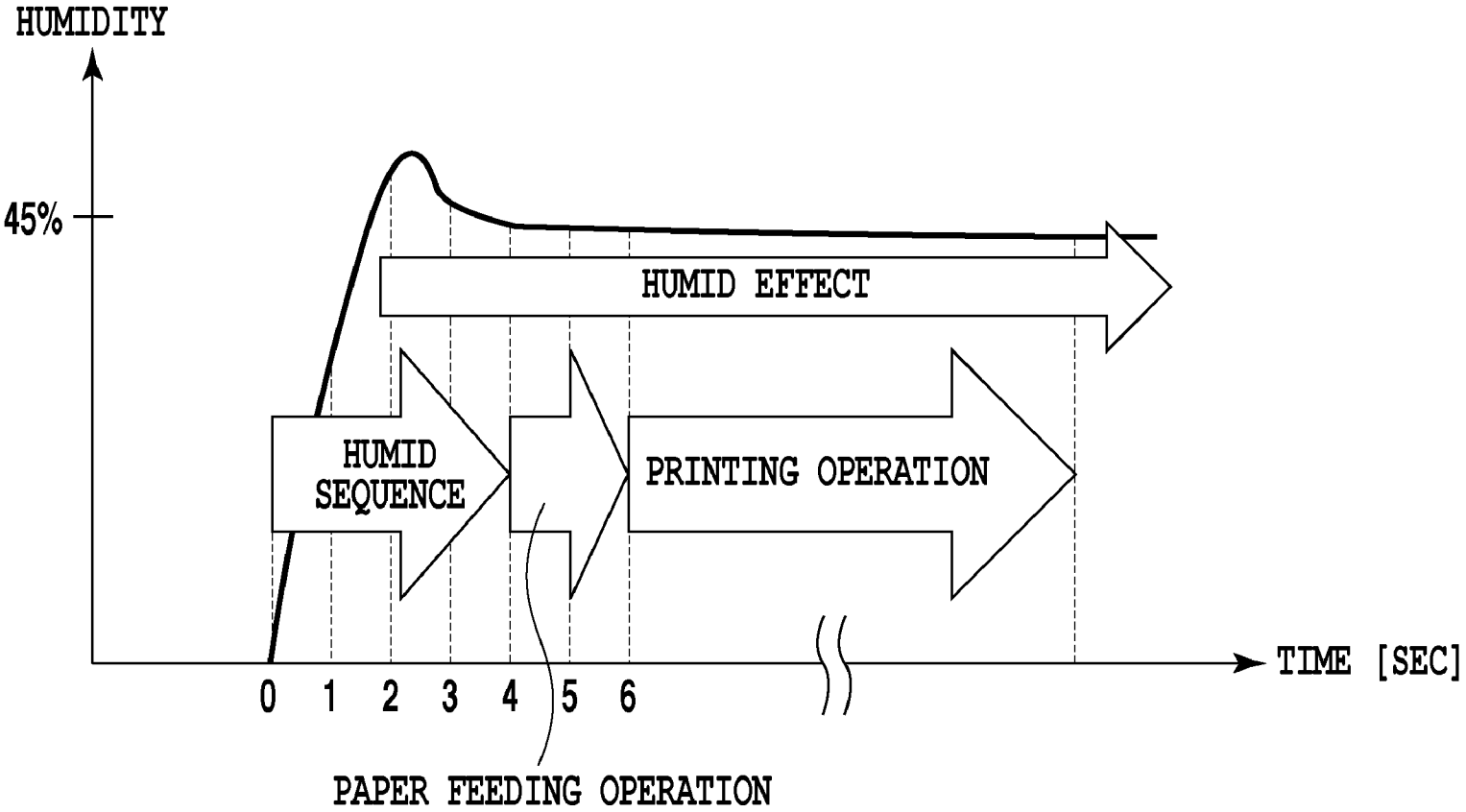
FIG. 14 is a graph illustrating the passage of the humidity time on the platen absorber.

FIG. 14 is a graph schematically illustrating the outline of a change in the humidity with the passage of time of the space above the platen absorber 18 from the distance of about 6 mm from the platen absorber 18 after the start of the humid sequence in this embodiment. The humidity in the space above the platen absorber 18 from the distance of about 6 mm from the platen absorber 18 increased immediately after the start of the humid sequence to increase to about 50% after 2 seconds. Thereafter, the humidity stayed in the vicinity of 60% for a period of at least 9 minutes and 30 seconds or more. In this embodiment, the time required for the humid sequence is about 4 seconds, the time required for the paper feeding operation is about 2 seconds, and the time required for the printing can be roughly calculated as 8 minutes and 57 seconds (time required for the printing)≈(the total number of scannings)×(scan time)≈8 minutes and 57 seconds.

Thus, the printing operation is started after 6 seconds after the start of the humid sequence. The printing operation is completed after 9 minutes and 3 seconds. Thus, the humid effect is maintained within a period from the start of the printing to the completion of the printing. The humid sequence described above could extend, in the environment of this embodiment, the stable ejection time from 1.0 second to about 1.45 seconds, thus assuring the normal ejection in one scanning.

Step S009 (Paper Feeding Operation)

In this step, a printing medium is subjected to a paper feeding. After the execution of the humid sequence Step S010 (normal printing operation), a paper feeding operation is performed and the print head is scanned to perform a normal printing operation.

(Other Embodiments) Other Embodiments Regarding the Ink Ejection Method in the Humid Sequence (Step S007 to Step S008)

In the above-described humid sequence, such ink is preferably ejected that has a high water mole fraction and that easily evaporates. For example, in the ink set of Embodiment 1, inks of light magenta (Lm), light cyan (Lc), and gray (Gray) are preferably used. In the above-described humid sequence, ink also may be ejected not only to the platen absorber 18 but also to any or both of the cap and the preliminary ejection receiver. In this embodiment, ink in an amount of 0.04 ml per 1 $cm^2$ is also ejected to the cap and the preliminary ejection receiver as in the ink ejection to the platen absorber 18. However, different inks also may be ejected to the cap and the preliminary ejection receiver and are not particularly limited.

Further in the first embodiment, the print medium is subjected to a paper feeding after the execution of the humid sequence. However, a timing of the paper feeding is not limited to this. The preliminary ejection by the humid sequence has only to be over before the print medium is transported, and a front end relative to the transport direction comes in contact with the platen or before the end is transported on the absorber.

Also if the length of the transport direction of the print medium is long, the humidification effect by the humid sequence may decrease during one piece of print. On the other hand, it's possible to make the humidification effect continue by increasing and decreasing an amount of the preliminary ejection by the humid sequence according to the length of the transportation direction of the print medium.

For example, the amount of the preliminary ejection of the humid sequence before printing on a print medium whose length of the transportation direction is the first length is larger than the amount of the preliminary ejection of the humid sequence before printing on a print medium whose length of the transportation direction is the second length which is shorter than the first length. Therefore it is possible to print while continuing the humidification effect for the print medium with a large length of transportation direction.

As described above, ink is ejected to the platen absorber and is humidified. Then, the water evaporated from the platen absorber is used to humidify the nozzle section of the print head. This can provide, even under an environment in which water in ink easily evaporates (e.g., a high temperature and a low humidity), the humidification of the ambience near the nozzle opening by the control depending on the temperature and humidity or the printing mode. Thus, such an inkjet printing apparatus could be realized that can provide a high-quality printing while reducing the amount of waste ink or cost.

The following section will describe the second embodiment of the present invention with reference to the drawings. The basic configuration of this embodiment is the same as that of the first embodiment. Thus, only a distinguishing configuration will be described below.

Figure 15:
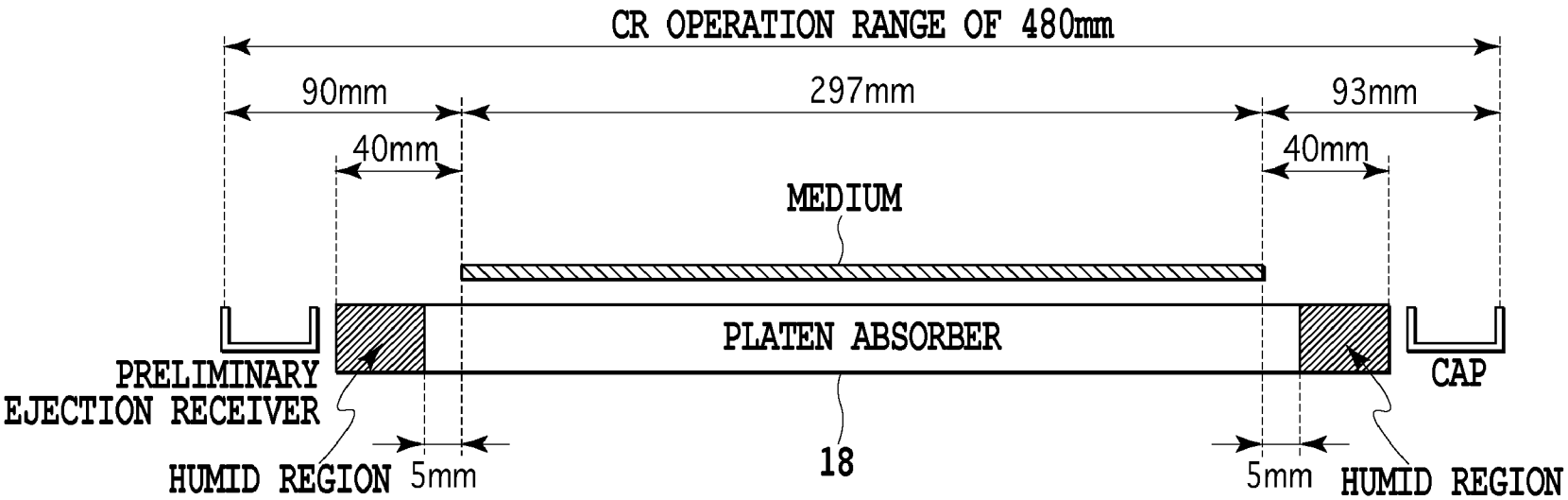
FIG. 15 is a schematic diagram of the humid region in the second embodiment.

In the second embodiment, in addition to the humid sequence prior to the paper feeding operation, an ink ejection for the purpose of additionally supplying water is performed during a printing operation based on the temperature and humidity and the printing mode. The following section will describe an ink ejection region when the ink ejection for the purpose of additionally supplying water is performed during a printing operation. In this embodiment, ink is ejected to a region except for the regions having a distance of 5 mm from both sides of the printing medium passing range and the printing medium passing range to the outer sides among the carriage operation range. The distance of 5 mm means an error of the transport of the printing medium in the carriage operation direction in the inkjet printing apparatus of this embodiment. FIG. 15 is a schematic view illustrating the humid region of this embodiment. This control can avoid the printing medium passing range and the ink ejection range in the humid sequence from being overlapped to each other, thus reducing the possibility where unnecessary ink is attached to the printing medium.

As described above, ink is ejected to the platen absorber and humidified during printing. Then, water evaporated from the platen absorber is used to humidify the nozzle section of the print head. This can provide, even under an environment in which water in ink easily evaporates (e.g., a high temperature and a low humidity), the humidification of the ambience near the nozzle opening by the control depending on the temperature and humidity or the printing mode. Thus, such an inkjet printing apparatus could be realized that can provide a high-quality printing while reducing the amount of waste ink or cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-188432, filed Aug. 25, 2010, and Japanese Patent Application No. 2011-178088, filed Aug. 16, 2011 which are hereby incorporated by reference herein in its entirety.

What is claimed is:

1. An inkjet printing apparatus, comprising:

a transport unit for transporting a printing medium;

a printing unit for performing printing by ejecting ink while scanning a surface of the printing medium;

an absorber that is provided at a position opposed to a location of the printing unit during printing, and at a backside of the print medium during printing, that can absorb the ink ejected from the printing unit; and a control device that determines, upon receiving information instructing printing, a region of the absorber to which ink is to be ejected based on information regarding a size of the printing medium to be transported next and that controls, before the print medium is transported on the absorber, the printing unit so that ink is ejected to the region.

2. The inkjet printing apparatus according to claim 1, wherein:

the region includes a part of a region that is on the absorber in which the printing medium transported by the transport unit passes.

3. The inkjet printing apparatus according to claim 1, wherein:

the control device determines, based on the information regarding the size of the printing medium, a second region in which ink is ejected from the printing unit to the absorber and controls the printing unit so that ink is ejected to the second region of the absorber while the printing medium is transported over the absorber, and the second region does not include a region in which the printing medium passes.

4. The inkjet printing apparatus according to claim 1, wherein:

information regarding a size of the printing medium includes information regarding a width in a scanning direction of the printing unit.

5. The inkjet printing apparatus according to claim 4, wherein:

the control device sets, when the control device receives information instructing printing on a printing medium whose width in scanning direction of the printing unit is a first length, an amount of the ink ejected to the region to be larger as compared with when the control device receives information instructing printing on a printing medium whose width in scanning direction of the printing unit is a second length shorter than the first length.

6. The inkjet printing apparatus according to claim 1, wherein:

the control device controls the printing unit so that ink is ejected to the region before the front end of the print medium relative to the transport direction is transported to a position at the time of print.

7. The inkjet printing apparatus according to claim 1 further comprising a platen for guiding and supporting the print medium, the platen being provided in a position opposite to the print unit at the time of print, wherein the absorber is integral with the platen.

8. The inkjet printing apparatus according to claim 1 further comprising a sensor that measure at least one of a temperature or humidity in the apparatus, wherein the control device judges whether or not to eject ink to the region according to a measurement result of the sensor, and controls the printing unit based on a judgment result.

* * * * *